United States Patent [19]

Gilbert

[11] Patent Number: 4,755,001

[45] Date of Patent: Jul. 5, 1988

[54] ROAD PLANAR

[76] Inventor: Jerry F. Gilbert, 3545 E. Main St., Grand Prairie, Tex. 75050

[21] Appl. No.: 904,937

[22] Filed: Sep. 8, 1986

[51] Int. Cl.[4] ..... E02F 5/00; E01C 23/12

[52] U.S. Cl. ..... 299/39; 404/90; 37/87; 37/190

[58] Field of Search ..... 299/39, 76, 67; 404/90, 404/91; 37/87, 189, 190, 80 A, DIG. 16, DIG. 20

[56] References Cited

U.S. PATENT DOCUMENTS

| | | | |
|---|---|---|---|
| 1,519,897 | 12/1924 | Asplund | 37/87 |
| 1,684,869 | 9/1928 | Krueger | 37/87 |
| 1,740,923 | 12/1929 | Jaeger | 37/87 |
| 2,568,402 | 9/1951 | Lynn | 37/DIG. 20 |
| 3,318,638 | 5/1967 | Kilbourne | 299/76 |
| 3,528,078 | 9/1970 | Taylor | 37/86 |
| 3,538,629 | 11/1970 | Hemphill | 37/195 |
| 3,651,588 | 3/1972 | Hanson | 37/DIG. 20 |
| 3,663,063 | 5/1972 | Johnmeyer | 299/39 X |
| 3,968,995 | 7/1976 | Arentzen | 299/82 |
| 4,041,623 | 8/1977 | Miller et al. | 299/39 X |
| 4,139,318 | 2/1979 | Jakob et al. | 404/90 |
| 4,186,968 | 2/1980 | Barton | 299/39 |

FOREIGN PATENT DOCUMENTS

| | | | |
|---|---|---|---|
| 321601 | 1/1972 | U.S.S.R. | 37/189 |
| 663795 | 5/1979 | U.S.S.R. | 37/DIG. 20 |

*Primary Examiner*—Stephen J. Novosad
*Assistant Examiner*—Terry Lee Melius
*Attorney, Agent, or Firm*—Marcus L. Bates

[57] ABSTRACT

A digging machine for planing a road. The machine has a massive main frame supported by large endless tracks. An elongated digging member has spaced shafts located at the opposed ends thereof. One of the shafts pivotally supports the digging member from the rear end of the main frame, while the other shaft rotatably supports a digging head. The digging head is rotated by spaced, endless chains that are driven by sprockets located on the pivot shaft and thereby rotates sprockets located on the other shaft. Cutter plates are supported by the spaced chains and form an endless cutter member. Opposed drums are mounted on opposed marginal ends of the driven shaft and are rotated by the driven sprockets. The drum surface has flights formed thereon. Digging teeth are mounted on the outer periphery of the flights and cutter plates. The digging head can be made as wide as the vehicle and thereby excavates adjacent to a vertical wall. The excavated material is conveyed by the endless cutter member up to a lateral conveyor where the material is deposited to one side of the digging machine.

6 Claims, 7 Drawing Sheets

ROAD PLANAR

BACKGROUND OF THE INVENTION

The construction of roadways and highways require that a considerable amount of material be removed to provide a road bed which is at a specific elevation so that the road bed neither climbs nor descends abruptly. This requires the removal of a considerable amount of material from the high places and depositing the material into the low places. Often the high places are located in rocky terrain and ordinary excavating machines are unable to economically remove the rocky material.

Sometime the rocky material is partially removed by blasting with explosives followed by bringing in suitable filling material so that a smooth road bed is achieved. Then the final road building material is applied to the bed.

Construction of road beds through mountains usually necessitates that the road bed be built adjacent to a shear cliff or vertical wall. Most rock removing machinery cannot make a cut at the base of a vertical wall for the reason that the apparatus that manipulates the digging teeth for excavating the rocky material usually is never as wide as the remainder of the machine. Accordingly, a stair-step series of cuts usually must be accepted when a road bed is constructed using prior art road building equipment.

It would be desirable to have made available a digging machine for planing a road wherein the digging machine includes a digging head thereon for digging in rocky terrain, and which can dig adjacent to a vertical wall. It would also be desirable that the digging machine forms a smooth road bed while removing the excavated material to a location away from the excavation. A digging machine of this type which can dig to a considerable depth and form an unusually smooth, wide road bed is the subject of the present invention.

SUMMARY OF THE INVENTION

A digging machine for planing a road comprising a main frame having a prime mover and a drive train therewithin. The machine is ground supported from an endless track assembly, which is longitudinally disposed at opposed sides thereof.

An elongated digging member is mounted at the rear of the main frame and has a near end and a far end, with there being spaced drive sprockets located at the near end thereof, and spaced driven sprockets being mounted to a shaft located at the far end of the digging member. Means pivotally mount the near end of the elongated digging member to the trailing end of the main frame.

A digging head, made in accordance with the present invention, is supported by the far shaft. Spaced endless chains are connected about the sprockets located at the near and far ends of the digging member. Cutter plates are supported by the endless chains and form a wide, endless, digging member. Digging teeth are mounted to the outer surface of the cutter plates.

Opposed digging drums are mounted for rotation on opposed marginal ends of the far shaft. Flights formed on the drums support a plurality of digging teeth about the outer periphery thereof. The digging head is pivoted to the desired elevation to cause the digging teeth located on the drums and cutter plates concurrently to engage the road bed and remove material therefrom.

The digging head drum flights are of a pitch to cause excavated material to move toward the centrally located endless digging member.

During normal operation, the lower run of the endless digging member is inclined upwardly in a direction towards the pivoted end thereof and thereby conveys excavated material towards the pivoted end as the material is removed by the digging head. A lateral conveyor is arranged to receive the excavated material and convey the excavated material laterally away from the digging machine where the material is deposited adjacent to the excavation.

A shield means extends partially about the digging head and forms a segment of a circle. The shield means includes a fixed part and a movable part. The movable part of the shield means is slidably received respective to the first part of the shield means and can be moved circumferentially about part of the digging head to enclose more or less of the circumference of the digging head. A shoe provided at the lower end of the movable part of the shield means supportedly engages the road bed surface and gauges the depth of the excavation by supporting the digging head from the road bed and thereby providing a guide means therefore which limits the depth of the excavation.

The elongated digging member has a near end journaled to a shaft pivotally connected to an upper part of the main frame so that the far end of the digging member can be pivoted about the shaft at the near end thereof. Hydraulic cylinders are connected between the main frame and the elongated member and thereby pivotally adjusts the elevation of the digging head. Hydraulic cylinders connected between the movable and fixed parts of the shield means adjust the elevation of the shoe respective to the elevation of the digging head.

The apparatus of the digging machine is controlled from an operator's cab which can be elevated as may be needed to enhance the ability of the operator to visually observe the action of the digging head.

Accordingly, a primary object of the present invention is the provision of a road planing machine having an elongated pivoted digging head for excavating material wherein the digging head is made as wide as the digging machine.

Another object of the present invention is the provision of an excavating machine having an elongated digging member, one end of which is pivotally attached to the machine with the opposed end thereof forming a digging head, with there being an endless digging member included which digs and conveys excavated material away from the excavation.

A further object of this invention is the provision of an excavating machine having an elongated excavating apparatus pivotally mounted to the rear end of the machine for changing the elevation of a digging head located at the far end of the elongated excavating apparatus, wherein the digging head is comprised of a central digging member and opposed digging drums attached to the central digging member, with the central member being an endless chain having digging teeth attached thereto for excavating and conveying the excavated material.

Another and still further object of this invention is the provision of an excavating machine including an elongated digging member having a near end pivotally attached thereto, with there being a digging head at the far end thereof, and a shield means attached about the digging head with there being a movable part of the shield means attached for controlling the elevation of the digging head.

An additional object of this invention is the provision of a digging machine having a main body which moves along the ground and supports an elongated digging member from the trailing end thereof, with the elongated digging member having a pivoted end connected to the main body and a digging head at the other end thereof, wherein the digging head includes a combination digging implement in the form of an endless chain which excavates material and transports the material to a lateral conveyor.

A still further object of this invention is the provision of a planing machine having a two part main frame member pivotally connected together with there being provisions by which one member is pivoted respective to the other to cause the planing machinery to dig a level road bed.

Another and still further object of this invention is the provision of a planing machine having a digging head which is pivoted respective to the horizontal to cause the digging head to dig a road bed of any desired slope.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
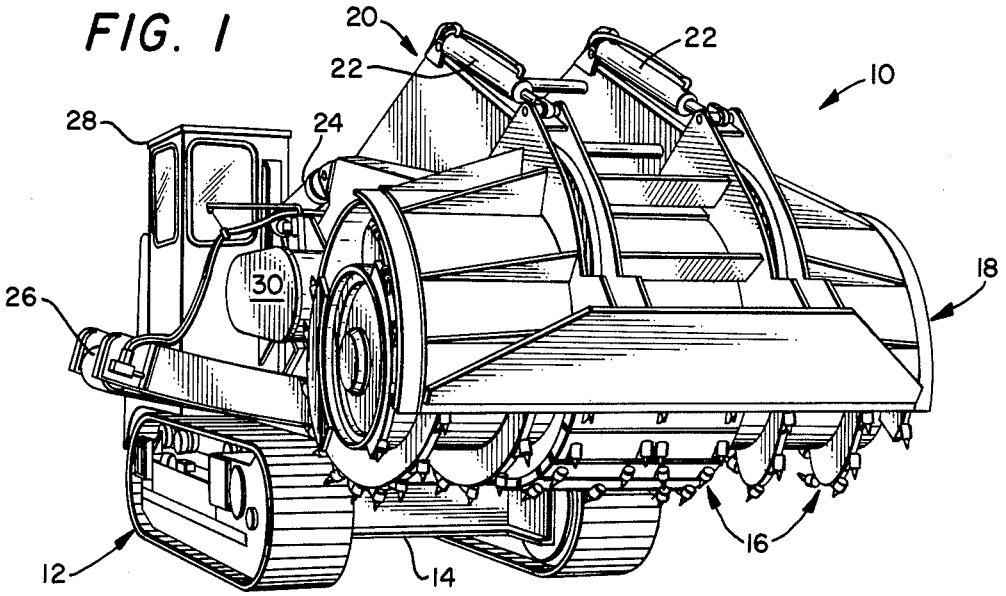
FIG. 1 is a three-quarter rear, perspective view of a digging machine made in accordance with the present invention.
Figure 2:
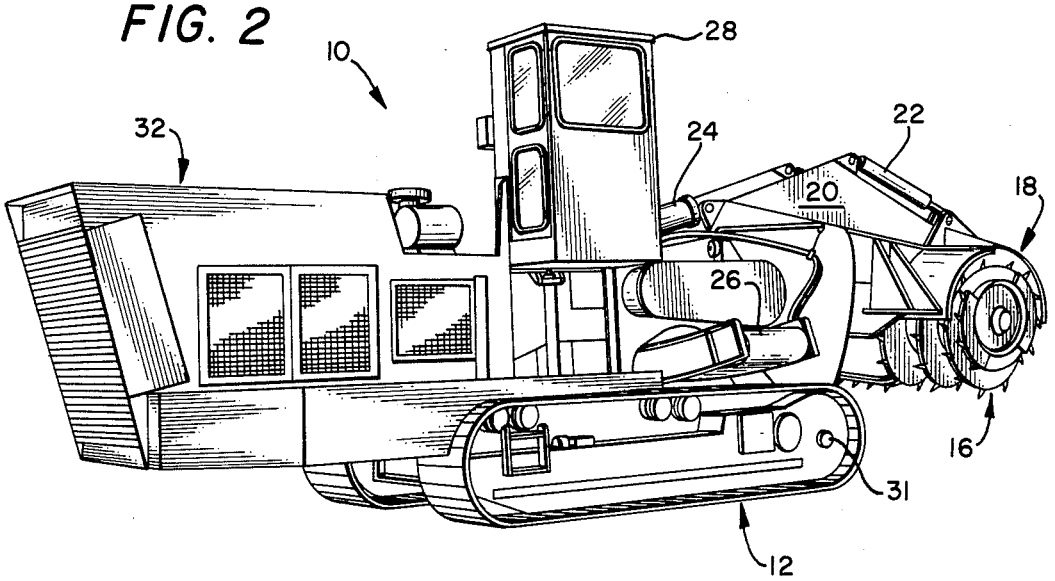
FIG. 2 is a perspective, side view of the opposed end of the digging machine seen in FIG. 1.
Figure 3:
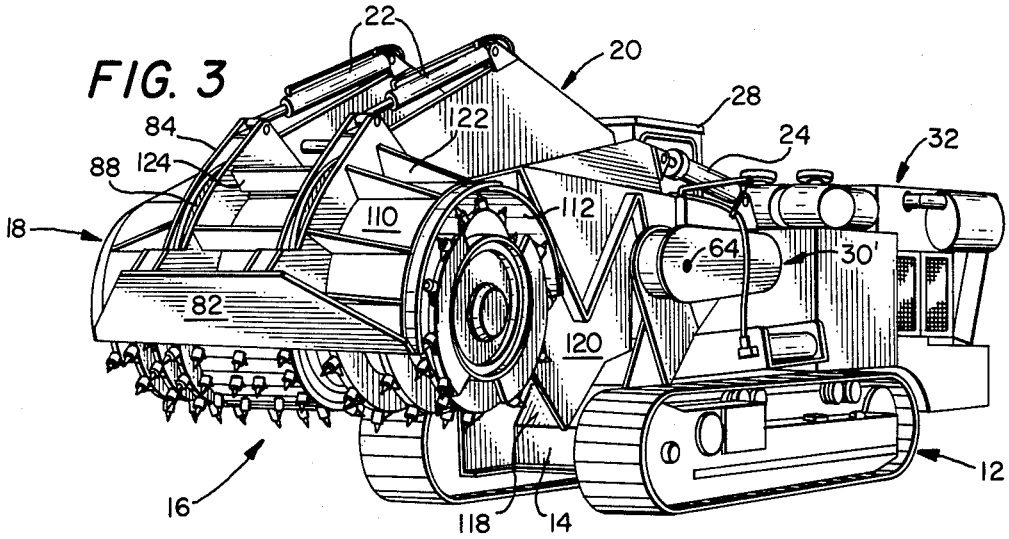
FIG. 3 is a three-quarter, side, elevational view showing the side opposite of FIGS. 1 and 2.

In the figures of the drawings, and in particular FIGS. 1–3, there is disclosed a digging machine 10 for excavating material and particularly for planing a road. The digging machine is track mounted as indicated by the opposed endless tracks 12 which support the machine from the surface of the earth. The digging machine includes a main frame 14 from which there extends an elongated digging member having a digging head 16 at the far end thereof. The digging head includes a combination support and shield 18 which partially encloses the rotatable digging head therewithin. Numeral 20 generally indicates part of the super-structure that forms an extension arm by which the digging head 16 and the shield 18 are pivotally supported from the main frame 14.

As seen in FIGS. 1–6, a pair of hydraulic cylinders 22 are connected between a movable part of the shield 18 and the extension arm 20. Another pair of hydraulic cylinders 24 are connected between the main frame 14 and the extension arm 20 and pivots the digging head 16 respective to the main frame, thereby changing the elevation of the digging head 16, as will be more fully explained later on herein.

Figure 5:
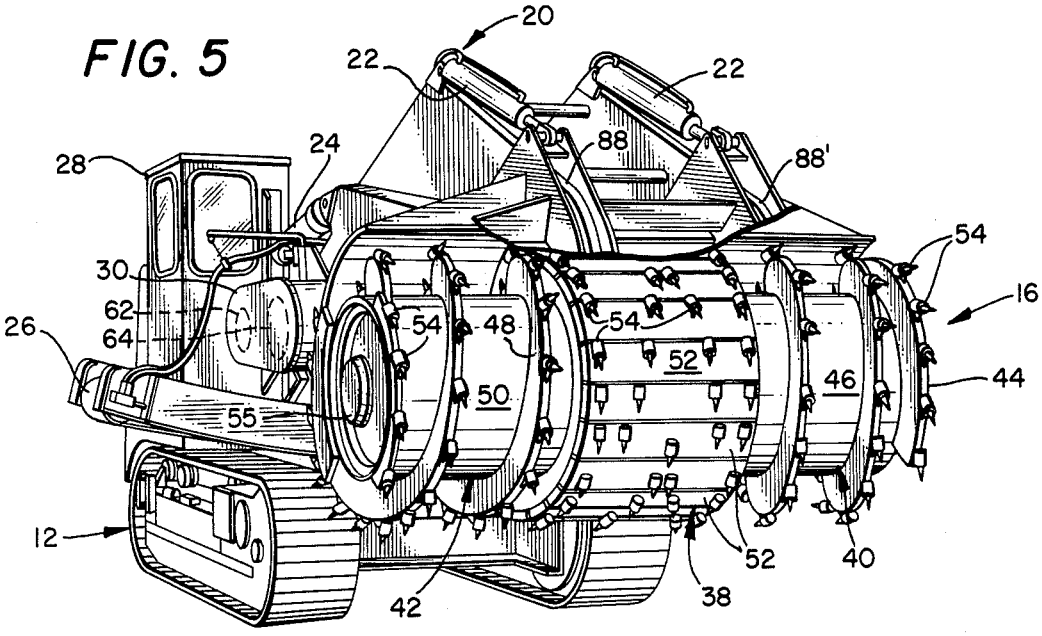
FIG. 5 is similar to FIG. 1, with some parts being broken away therefrom so as to disclose some of the underlying parts thereof.
Figure 6:
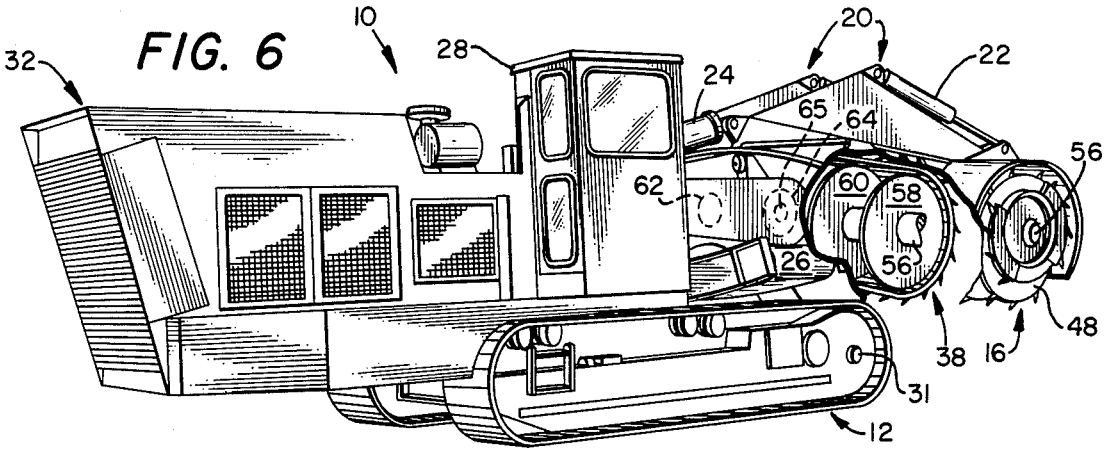
FIG. 6 is similar to FIG. 2, with some parts being broken away therefrom, and some of the other parts being shown in a different operative configuration.
Figure 7:
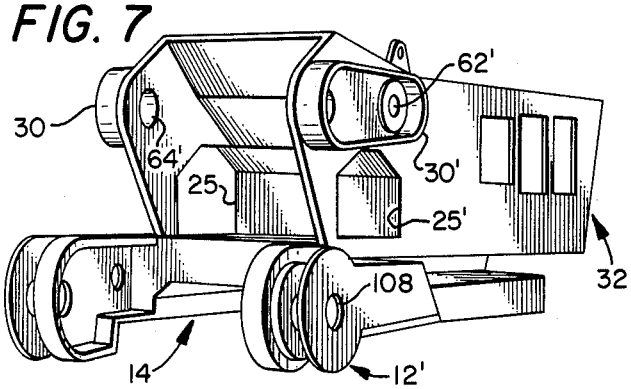
FIG. 7 is a rear, perspective view showing the main frame of the present invention.

As best seen illustrated in FIG. 7, together with other figures of the drawings, the main frame 14 has conveyor openings 25, 25' formed through opposed sidewalls thereof. As seen in FIGS. 1–6, a lateral conveyor 26 is supported by the main frame with the marginal ends of the conveyor extending through the opposed conveyor openings 25, 25'.

In FIGS. 1–6, an operator's cab 28 is captured for movement to the main frame 14 and can be elevated from the illustrated position of FIG. 1 into the illustrated position of FIG. 2. The details of the cab are more fully set forth in FIGS. 15 and 16, and will be more fully appreciated later on as this disclosure is more fully digested.

Figure 13:
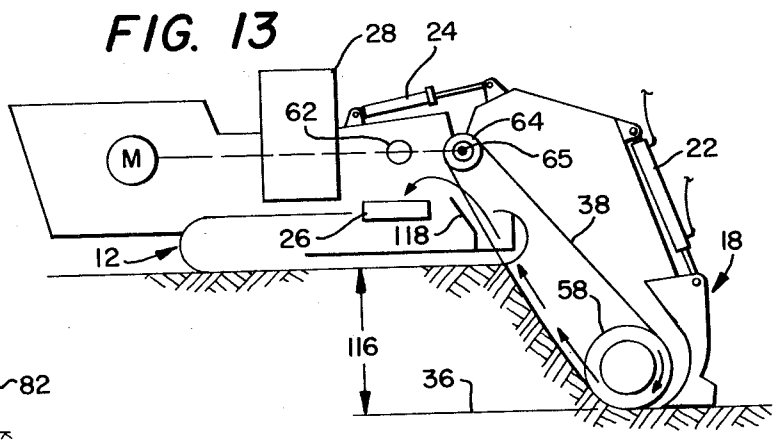
FIG. 13 is a diagrammatical representation of a side view of the present invention.

The elongated digging member of FIGS. 1–6 and 8–13 is connected to a drive system enclosed within the illustrated housing 30 as seen illustrated in FIGS. 1–7 and 12. The drive system, as diagrammatically set forth in FIG. 13, is powered by a 700 horsepower supercharged diesel prime mover M located within engine compartment 32 (FIG. 4) at the forward end of the digging machine 10. The prime mover counterbalances the digging head 16 and drives the tracks 12 by means of a gear sprocket journaled at 31 (FIG. 2) and 108 (FIG. 7).

In FIGS. 4 and 10–13, numeral 34 indicates the ground level while numeral 36 indicates the surface of the planed road bed 36. In FIG. 5, together with other figures of the drawings, the elongated digging apparatus is seen to include the digging head 16 at the pivotal or free end thereof, which includes a central digging member 38 which is the circular marginal end of an elongated endless digging member, as will be more fully explained later on herein. The digging head 16 further includes a right hand digging member 40 and a left hand digging member 42. The right and left digging members 40, 42 are attached to opposed sides of the central digging member 38. The digging member 40 has an auger flight 44 of constant diameter attached in a spiral about the outer periphery of a drum 46, while the opposed or left digging member 42 has a drum 50 attached to the opposed side of the central digging member 38, with there being a flight 48 of constant diameter attached in a spiral about the periphery of drum 50. The flights 44 and 48 are of opposite pitch, and are arranged to convey excavated material centrally towards member 38.

Figure 8:
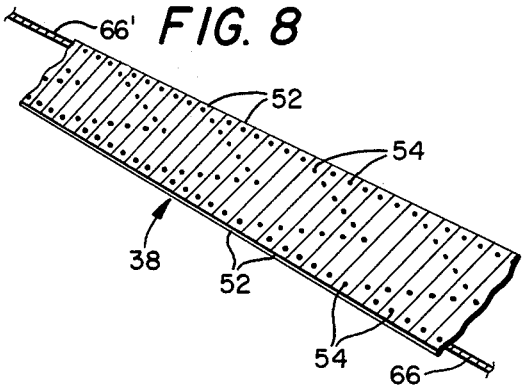
FIG. 8 is a fragmentary, detailed view of part of the apparatus disclosed in FIGS. 1–6.
Figure 9:
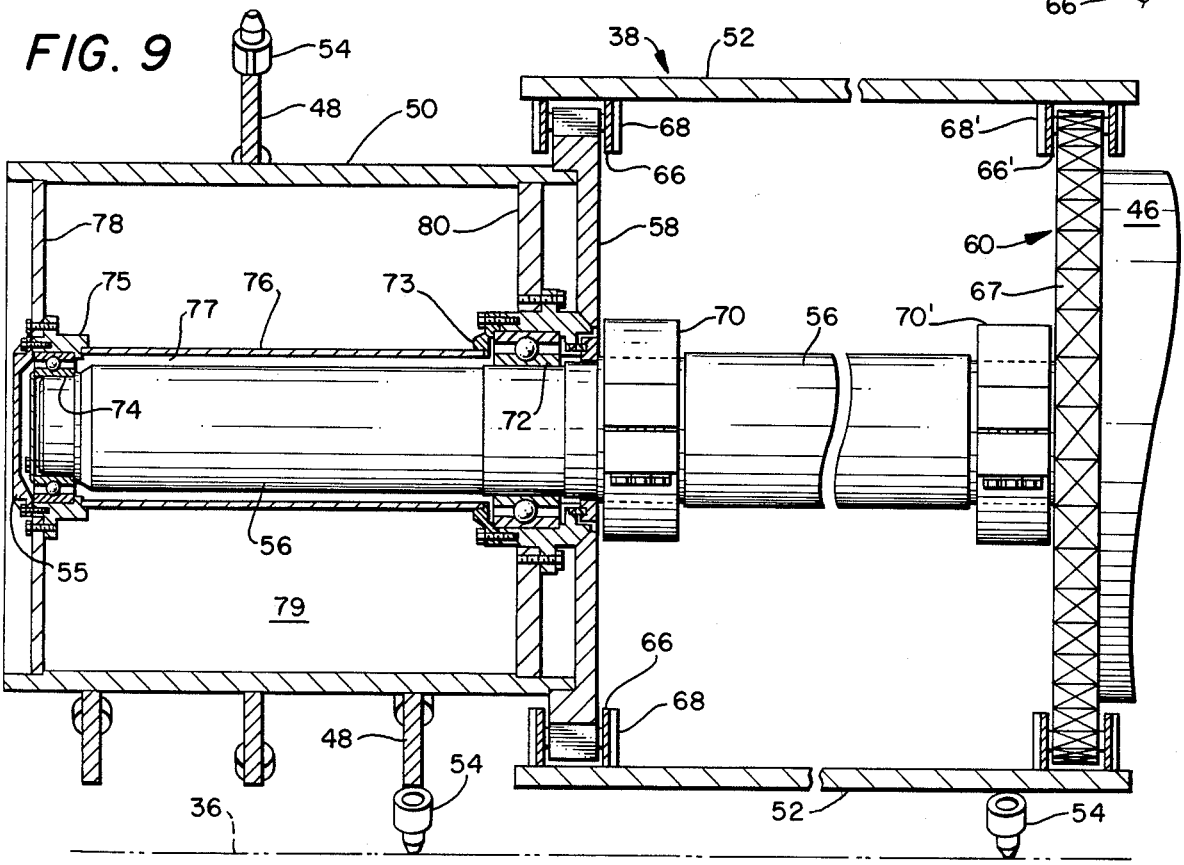
FIG. 9 is an enlarged, fragmentary, longitudinal, cross-sectional view of part of the apparatus disclosed in FIGS. 1–6.

The central digging member 38 includes a plurality of adjacent, series connected, tooth support means in the form of parallel cutter plates 52, which are rectangular in form, the details of which are more fully set forth in FIGS. 8 and 9. The outer peripheral surface of cutter plates 52 and flights 44, 48 are provided with a plurality of digging teeth 54 removably attached thereto in the illustrated manner of FIG. 14. Reference is made to U.S. Pat. No. 3,830,546 for more specific details of a suitable tooth and pocket design.

Looking now to the details of FIG. 9, in conjunction with other figures of the drawings, the left hand drum 50 of the digging head 16 is seen to have a cover 55 which isolates a dead drum shaft 56 from ambient. Spaced apart, confronting sprockets 58 and 60 are journaled to shaft 56. The sprockets, 58 and 60, respectively, are affixed to drums 50 and 46, respectively, and thereby rotatably drive the drums about the central axis of shaft 56.

Figure 12:
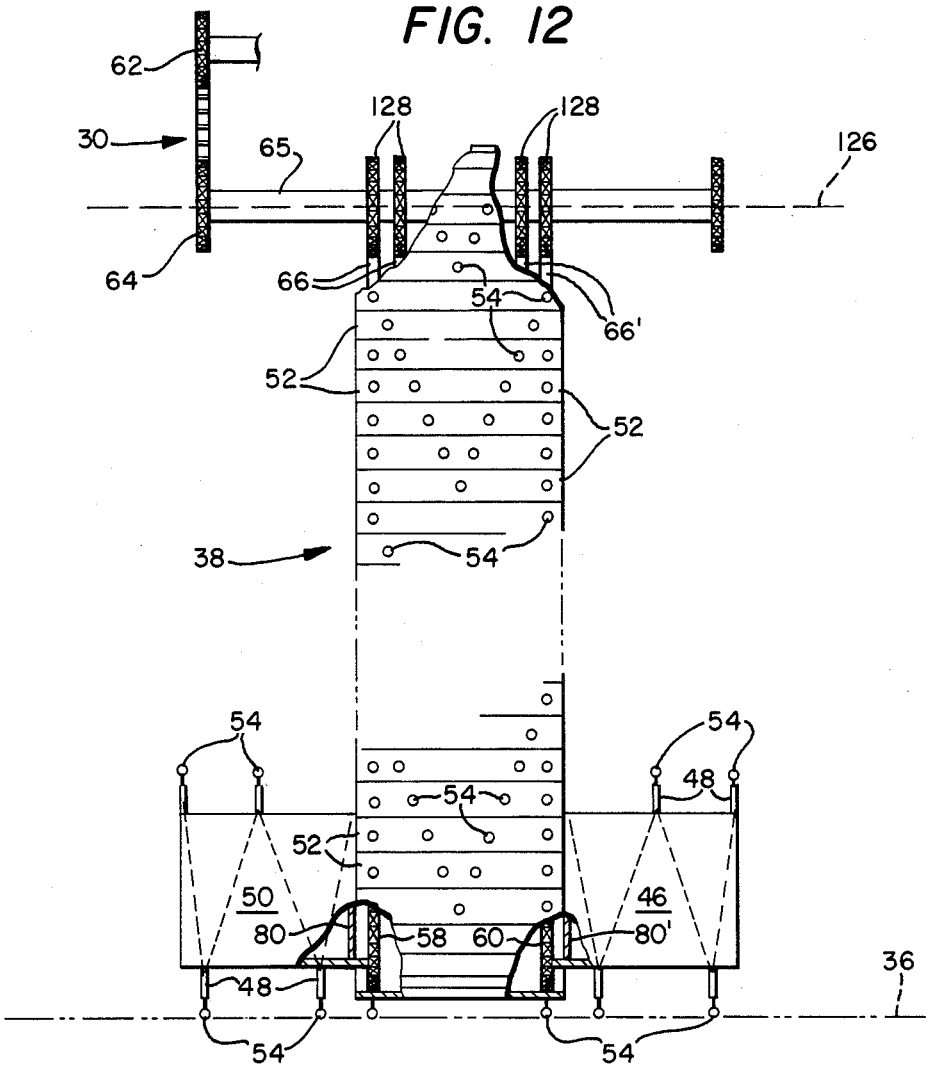
FIG. 12 is a diagrammatical, top, plan view of the apparatus disclosed in FIG. 10.

As best seen illustrated in FIGS. 6 and 12, the opposed drive systems 30, 30' house a drive sprocket 62 and a driven sprocket 64 therein. Drive sprocket 62 is powered by the prime mover M through a suitable conventional drive train (not shown). The driven sprocket 64 is affixed to shaft 65 which is more fully seen disclosed in FIGS. 7, 10, and 12. The near end of the elongated digging apparatus is pivoted to the main frame 14 by means of shaft 65.

Looking again to FIG. 9, together with other figures of the drawings, spaced apart chain means 66, 66' have alternate links thereof connected to the underside of the cutter plates 52 by members 68, 68'. The chains 66, 66' mesh with sprockets 58, 60 located at the digging head at the far end of the elongated digging apparatus, and mesh with sprocket 128 at the pivoted or near end thereof, so that the prime mover M causes the drive system 30 to rotate shaft 65, thereby moving the endless digging and conveying member 38 and causing the entire digging head 16 to rotate with great power input.

Clamps 70, 70' are affixed to and form the forward or terminal end of extension arm 20, and are connected to support the non-rotatable or dead shaft 56. Each marginal end of the dead shaft 56 carries an inner journal means 72 thereon which includes a load transfer bearing cap 73; and, an outer journal means 74 having a bearing cap 75 therein. A spreader cylinder 76 interconnects the bearing caps 73, 75 in sealed relationship therewith, and thereby forms a hermetically sealed oil annulus 77 between shaft 56 and spreader cylinder 76. End plates 78 and 80, respectively, transfer the load from drum 50 into the bearings 72 and 74, respectively. Judicious use of seal means at the various innerfaces enables the outer annulus 79 to be water filled in order to increase the weight of the digging head if it is desired to do so.

Figure 11:
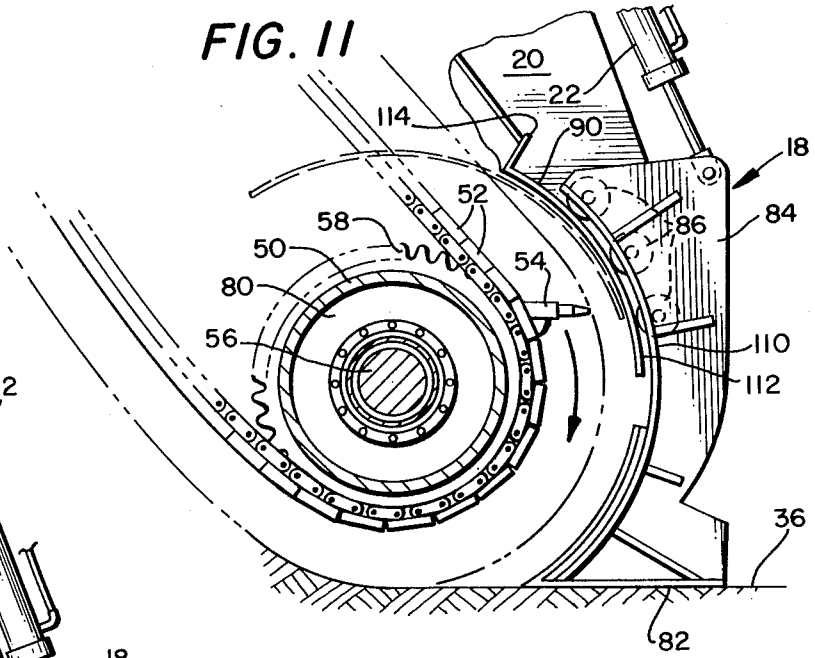
FIG. 11 is a fragmentary view of part of the apparatus disclosed in FIG. 10, and showing the apparatus in an alternate operational configuration.
Figure 10:
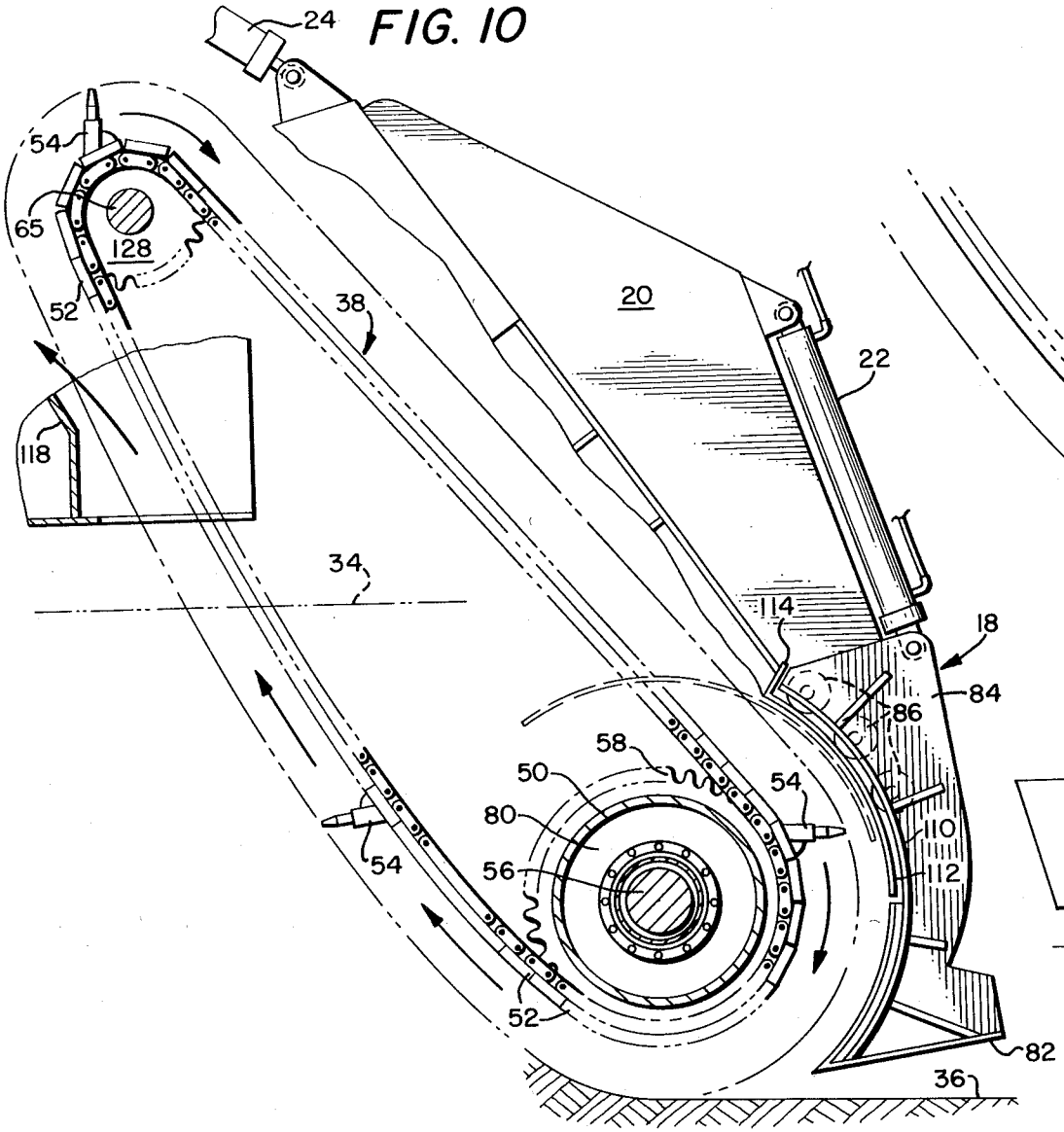
FIG. 10 is a part diagrammatical, part schematical, part cross-sectional, enlarged, side view which sets forth some more specific details of part of the apparatus disclosed in the foregoing figures.

Looking now to the details of FIGS. 10–12, in conjunction with other figures of the drawings, wherein the details of the novel elongated digging apparatus of this invention are further illustrated. As particularly seen illustrated in FIG. 10, the shield assembly 18 includes a shoe 82 which forms the outermost surface of pivoted shield member 84. The shoe 82, which forms part of the support and shield assembly 18 includes a plurality of rollers 86 which are attached to member 84 and captured to fixed member 112 to enable the shoe assembly 82 to be extended and retracted circumferentially about the digging head in response to actuation of the hydraulic cylinders 22. As seen in FIGS. 3 and 5, the illustrated guide 88 is received within the boxed-in structure of the pivoted shield member 84 and captures the movable shield member to the remainder of the shield assembly. In FIG. 11, numeral 90 indicates the fixed shield portion which circumferentially extends partially around the digging member 16, and which slidably receives the movable part 84 of the shield assembly 18 thereon.

In FIGS. 3, 10, and 11, it will be noted that the shield assembly 18 includes movable curved member 110 which is rotatable about the longitudinal axial centerline of the far shaft, and which rides on fixed curved member 112, with there being abutment means 114 formed therebetween which limits the retraction movement of the shield 18 respective to the support arm 20.

Figure 14:
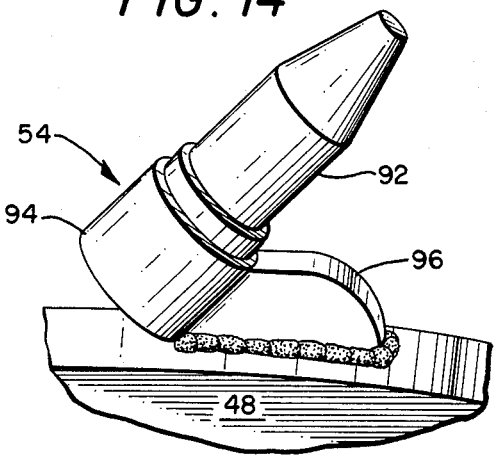
FIG. 14 is a fragmentary, enlarged, perspective view of part of the apparatus disclosed in some of the foregoing figures.

In FIG. 14, digging teeth 54 are preferably in the form of a rotatable rock type tooth 92, such as manufactured by Kennametal, Inc. of Latrobe, Pa. The tooth 92 is rotatably and removably received within a tooth pocket 94. The tooth pocket 94 includes a plate member 96 which is welded to the outer peripheral surface of flight 48 of digging head 16.

Figure 4:
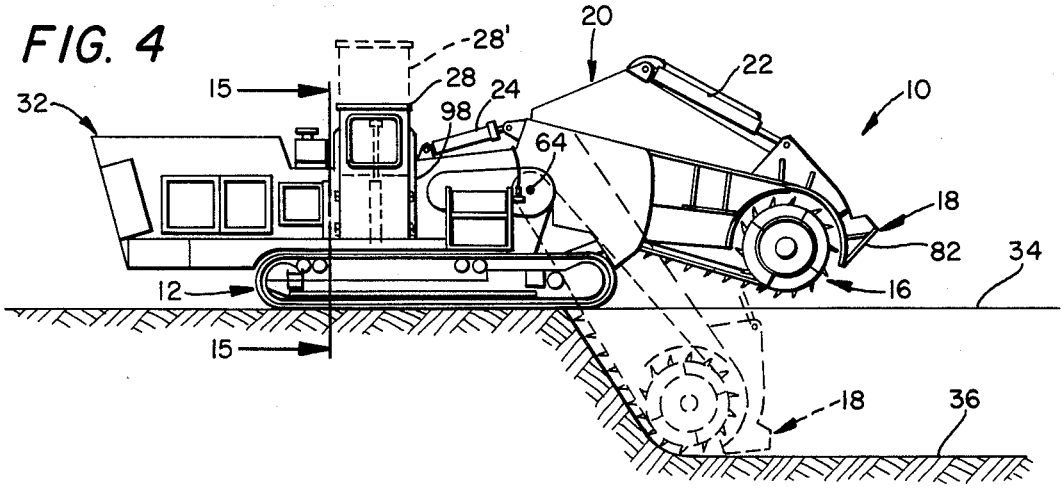
FIG. 4 is a part schematical, part diagrammatical, side view of the machine seen in the foregoing figures.
Figure 15:
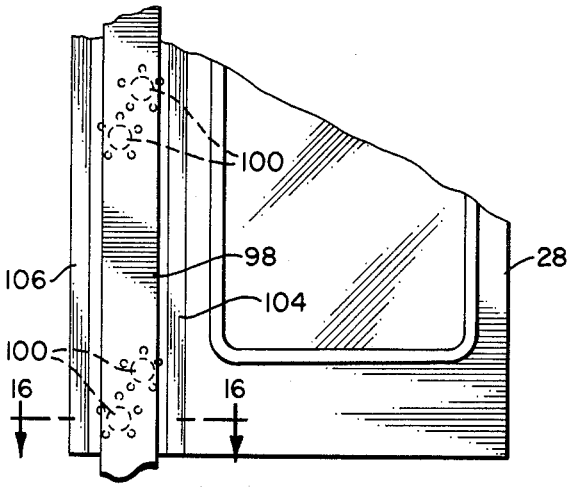
FIG. 15 is a fragmentary, detail of part of the apparatus looking in the direction indicated by the arrows 16—16 of FIG. 4.
Figure 16:
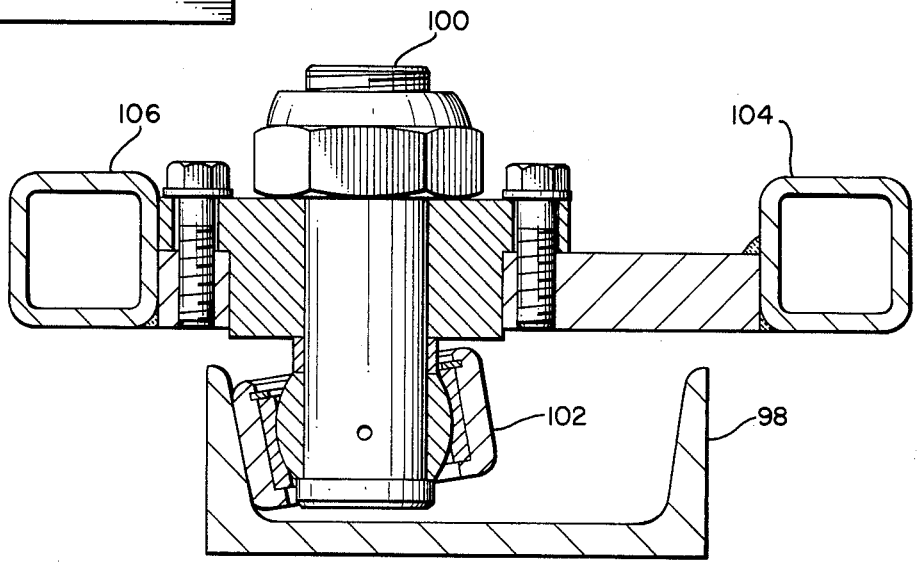
FIG. 16 is a cross-sectional view taken along line 16—16 of FIG. 15.

Looking now to the details of FIGS. 4, 15, and 16, it will be noted that the control cab 28 is slidably captured between vertical U-shaped guides in the form of channel members 98. The channel members confront one another and capture the illustrated journal means 102 therewithin so that the cab 28 can be elevated from the position indicated by numeral 28 to the position 28'. The journals 102 are attached to journal shaft 100 which in turn is connected to cab structure 104, 106 in the illustrated manner of FIGS. 15 and 16.

In FIG. 13, numeral 116 indicates the depth of the excavation as measured from the ground surface to the road bed 36. Numeral 118 schematically illustrates an upwardly sloped guide member which cooperates with the traveling endless digging member 38 to guide the excavated material onto the lateral conveyor 26. Side members 120 (FIG. 3) are part of the extension arm 20 and guide the excavated material away from the track assembly, and therefore forms the sides of a chute in conjunction with the main frame 14 and inclined member 118. The inclined member 118 is spaced in underlying relationship near the lower run of the endless digging member 38 and extends towards the side members 120.

In FIG. 3, the slidable curved member 110 is attached to the boxed-in member 84 by web members 122 and 124, thereby greatly reinforcing the entire movable part of the shield assembly so that tremendous bearing pressure can be effected at shoe face 82 by means of hydraulic cylinders 22.

In FIG. 12, the pivot point 126 of the elongated digging apparatus is seen to coincide with the axial centerline of shaft 65. Shaft 65 is connected to rotate pairs of sprockets 128 which drive the endless chains 66, 66' and thereby rotate the digging head 16 in the above described manner.

Figure 18:
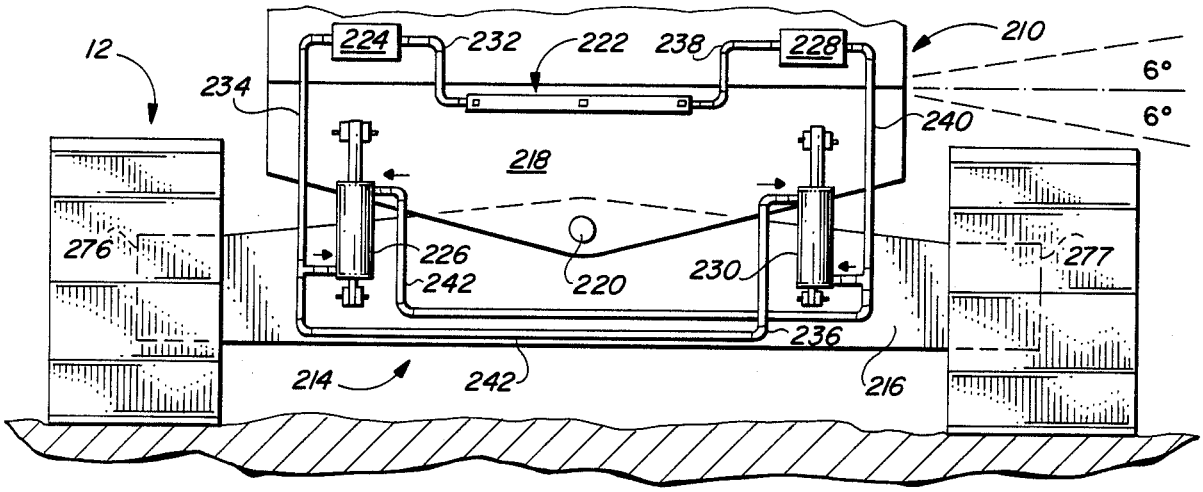
FIG. 18 is a part diagrammatical, part schematical, front view which sets forth a modification of a planing machine made in accordance with the present invention.
Figure 19:
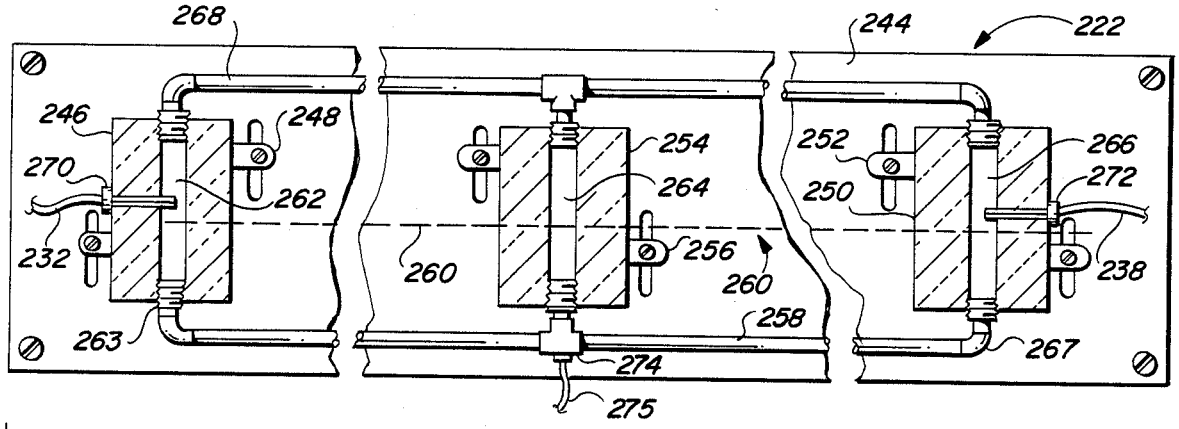
FIG. 19 is an enlarged, broken, front view of part of the apparatus disclosed in FIG. 18; and, FIG. 20 is a diagrammatical, part cross-sectional, fragmentary, side view of the apparatus disclosed in FIG. 18.
Figure 20:
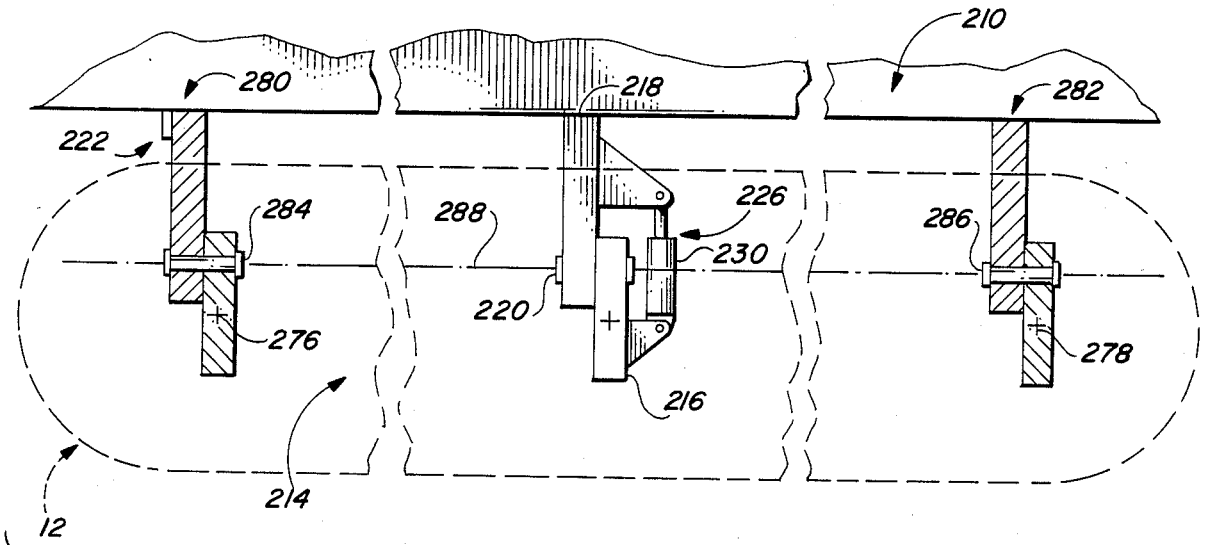

In FIGS. 18 and 20, the main frame of the planer machine is indicated by the numeral 214 and comprises a plurality of lateral main frame assemblies made of members 216 and 218 pivotally connected at pivot point 220. A sensor means 222 is in the form of an inclinometer, the details of which are set forth in FIG. 19. The inclinometer is mounted to one of the pivoted members 218 and senses an unlevel condition when the member 218 is slightly inclined respective to the horizontal.

Hydraulic flow systems 224 and 228 are suitably connected to the illustrated hydraulically actuated cylinders 226 and 230. Electrical conductors 232 and 238 are suitably connected from inclinometer 222 to actuate the hydraulic flow systems 224 and 228. Hydraulic flow lines 234, 236, 240, and 242 are connected between the hydraulic systems 224 and 228 and the hydraulic actuated cylinders 226 and 230. The systems 224 and 228 hydraulically actuate or stroke the pistons of the cylinders 226 and 230 in a direction to maintain the pivoted main frame member 218 horizontal within its range of pivotal movement. The range of pivotal movement preferably is 6° from dead center, as noted in FIG. 18.

FIG. 19 sets forth the details of the inclinometer 222 seen in FIG. 18. The inclinometer 222 includes a mounting plate 244 which can take on any number of different forms, so long as it can conveniently be mounted to one of the pivoted members of the main frame 214. A member 246 made of clear plastic is adjustably mounted to the flat surface of plate 244 by adjustable fastener means 248. The specific adjustment means of fastener 248 can take on any number of different forms, and as illustrated in FIG. 19, can be simply a nut and screw slidably received within the illustrated vertical slot. A similar block or body of plastic 250 is mounted at 252 adjacent the opposed marginal end of the mounting plate 244. A grounding block 254 is mounted to plate 244 by the illustrated fastener means 256. Tubing 258 is approximately ¼ inch diameter and preferably made of plastic or other electrical non-conductor. Numeral 260 indicates the mercury level of a quantity of mercury contained within the sensor device. Each of the three illustrated plastic members are provided with a vertical bore which form a mercury containing cavity at 262, 264, and 266. The bottom of the mercury containing bore is provided with a suitable pipe fitting or connection at 263, 267, and 274. Each of the cavities are vented to one another by means of the tubing 268 seen connected to the upper extremity of the bores.

The tee 274 is electrical conducting and is affixed to conductor 275. Electrodes 270 and 272, respectively, are affixed in mounted relationship to the walls of the blocks 246 and 250, respectively; with the electrodes having the illustrated electrical conductors 232, 238 leading therefrom and to the central valve of the hydraulic systems.

The inclinometer apparatus 222 is carefully leveled in aligned relationship respective to the member 218 so that the mercury level 260, when member 218 is absolutely horizontal, makes electrical contact only with the conductor connected to the conducting Tee 274. This is achieved by properly adjusting each of the blocks respective to one another so that the mercury level 260 barely clears the electrodes 270 and 272.

The plate member 244 can be mounted in the illustrated manner of FIGS. 18 and 20 to any part of the upper pivotal frame, as for example frame member 218. However, in the preferred embodiment of this invention, it is preferred to mount the sensor 222 at the rear frame member 280 adjacent to the pivoted end 64 of the digging head 16 of the planer apparatus.

During the planing of a road, the road bed engaging part of the digging head is maintained in a horizontal plane by the action of the spaced apart hydraulic cylinders 226 and 230. The electrodes 270, 272 can be positioned respective to the mercury level 260 such that a tilt of only a fraction of one degree will cause the hydraulic systems 224 and 228 to be actuated by the appropriate electrodes 270, 272 to thereby extend the piston of one of the cylinders while retracting the piston of the other of the cylinders, and thereby force the member 218 to pivot back towards the horizontal. Accordingly, as the planing machine moves along the ground, and the tracks proceed to travel over uneven terrain, the frame member 218 is continuously pivoted or tilted respective to the frame member 216 by the action of hydraulic cylinders 226, 230. The response rate of the cylinders can be adjusted by throttling the rate of flow between the hydraulic system and the hydraulic cylinders in a manner known to those skilled in the art.

The inclinometer can be adjusted to impart a predetermined amount or degree of slope into a road bed, as may be desired when building a curved road, or the like.

As seen in FIG. 18, up to six degrees tilt to either side can be conveniently designed into the range of movement of the main frame 214, which will prove adequate for most digging operations.

In FIG. 20, the main forward and rear track sprockets are attached to opposed frame members 276 and 278. Frame member 216 can advantageously be used for supporting an intermediate or medial part of the track. Frame members 218, 280, and 282 are attached to the illustrated body of the planing machine. Pivot mechanisms 220, 284, and 286 permit the main body to be tilted laterally respective to the track 12. The hydraulic cylinders 226, 230 preferably are suitably attached to the central members 216, 218 of the main frame 214.

When the mercury level rises within block 246 and makes electrical contact with electrode 270, a current flow path is established between the hydraulic flow system 224 to the electrode 270, through the mercury contained within the left hand side of the tubing 258, to the Tee connection 274, and back to the hydraulic flow system 224, thereby providing a signal for actuating the hydraulic system 224 to cause a hydraulic pressure to be effected along hydraulic flowlines 234 and 236. This action extends the piston of hydraulic cylinder 226 and retracts the piston of hydraulic cylinder 230. Fluid on the opposed sides of the pistons is returned to the other hydraulic system 228. Hydraulic fluid pressure continues to flow at 234 until the contact between electrode 270 and the mercury is broken due to the machine being leveled, or until the pistons of the hydraulic cylinders have been moved to the limit of their travel.

Accordingly, the present invention provides a planing machine having a digging head of unusual width which is always maintained level at the digging surface thereof, wherein the digging head includes an endless central digging member which rotates the digging head and simultaneously conveys the excavated material away from the excavation, while the opposed marginal ends of the digging head are arranged to convey excavated material towards the central digging member, and a lateral conveyor is arranged respective to the upper end of the endless central digging member to convey the excavated material laterally away from the planing machine.

IN OPERATION

In operation, the apparatus of the present invention can be designed to dig to a depth of 14 feet and a width of 11 feet. The 180,000 pound massive road planing machine cuts through rock and leaves a level road bed ready for the application of a road building material. The apparatus can excavate a road bed which commences at the base of a shear vertical wall.

As seen in the schematical illustration of FIG. 13, a motor M serves as a prime mover for the elongated digging apparatus, for moving the tracks 12, and for operating the hydraulic cylinders 22 and 24. The prime mover operates the drive system 30, thereby rotating the near shaft 65 of the digging apparatus, which in turn rotates sprockets 128 which are meshed with the chains 66, 66' of the endless digging member 38. The chains 66, 66' are meshed with the spaced sprockets 58, 60 of the digging head and thereby rotate the digging head so that the digging teeth at the central, right, and left digging members 38, 40 and 42 concurrently engage the terrain and excavate material therefrom in accordance with the depth 116 to which the digging head has been pivoted.

Figure 17:
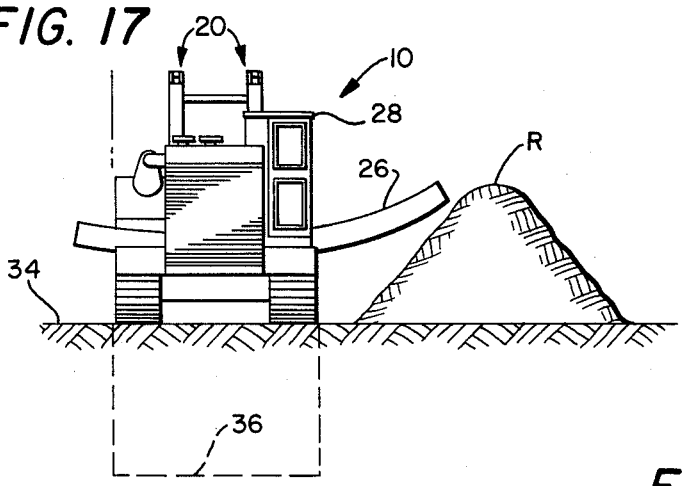
FIG. 17 is a schematical, front view showing the digging machine of this invention in operation.

The tracks 12 move the excavating machine along the ground at a velocity which depends upon the rate of penetration of the digging head. The excavated material, as seen in FIGS. 4, 10, and 13, is moved by the members 40, 42 towards the central member 38. The central member 38 conveys the excavated material up the sloped cut formed by the central digging member 38 and onto the lateral conveyor 26 where the excavated material is deposited in a row R as seen in FIG. 17.

The hydraulic cylinders 24 are used for pivoting the digging head about the shaft 65. The hydraulic cylinders 24 can be used to apply additional weight to the digging head. The shield 18 confines the excavated material in close proximity to the digging head and provides a means by which the depth of the excavation can be precisely adjusted. The shoe 82 rides on the surface of the excavation and accurately gauges the depth to which the teeth can dig.

I claim:

1. Excavating machine for planing a road, comprising a main frame; means, including a prime mover and drive train, for moving said machine along the ground;

an elongated digging apparatus that includes a superstructure that forms an extension arm having a near end and a far end, spaced drive sprockets at the near end thereof, a shaft at the far end thereof, means pivotally mounting said near end to said main frame; spaced sprockets rotatably supported on said shaft;

a digging head supported by said shaft, spaced endless chains connected about the sprockets at the near and far ends of the extension arm, tooth mount means supported by said endless chains which form an endless central digging and conveying member;

said shaft having opposed ends, said digging head includes drums mounted for rotation on opposed marginal ends of the shaft, flights formed on said drums; digging teeth mounted on the drum flights and on the tooth mount means for excavating a road; the flights on said drums are of a pitch to cause excavated material to move towards the endless central digging member; means by which said drums are rotated by the sprockets at the far end of the extension arm;

means for receiving material from the endless central digging and conveying member and moving any excavated material from proximity of the digging machine;

a shield means attached to the far end of said extension arm, said shield means extends across the width of the digging head and circumferentially around part of the circumference of the digging head in spaced relationship to said shaft and describes a segment of a cylinder; said shield means includes a fixed segment from which there is supported a movable segment, means forming a support shoe on the lower end of said movable segment for engaging the ground; said fixed segment is connected to the far end of said extension arm in a location which positions the interior surface of the shield means in close proximity to the exterior surface of the digging head whereby debris thrown by the digging head can be intercepted by the shield means; means by which the fixed and movable segments are forced to slide respective to one another to effectively change the circumferential length of the shield means and thereby extend the shoe into contact with the ground and support the far end of the extension arm respective the ground to thereby adjust the elevation of the digging head respective to the ground.

2. The digging machine of claim 1 wherein said shaft is fixed in supported relationship respective to said extension arm, the near end of said extension arm is pivotally connected to said main frame along an axis which coincides with the axis of the drive sprockets; and said means by which the fixed and movable segments are forced to move respective to one another is a hydraulic cylinder assembly connected therebetween to change the circumference thereof when it is desired to change the elevation of the digging head.

3. The digging machine of claim 2 wherein said means for moving said machine is spaced endless tracks arranged on opposed sides of said main frame, said extension arm is journaled to said main frame and includes means attached thereto for pivoting the digging head from a position above the ground to a position where the digging head is supported by said shoe; said means for removing the excavated material includes a lateral conveyor;

said digging head has a width equal to the overall width of the machine; the flights located on the opposed drums are of a pitch to cause excavated material to move towards the endless central digging member; whereby;

said endless digging member conveys excavated material upwardly to the lateral conveyor, and the lateral conveyor conveys the excavated material away from the digging machine.

4. An excavation machine for planing a surface of the earth, comprising:

a main frame, an elongated digging apparatus that includes a superstructure that forms an extension arm having a near end opposed to a far end, with the near end having means by which it is pivotally attached at one end of said main frame, a prime mover mounted at the other end of said main frame;

means by which a pair of spaced sprockets are supported at each of the opposed ends of said extension arm; an endless digging member comprising two parallel spaced endless chains meshed with said sprockets and supporting a plurality of cutter plates which are affixed to the outer surface of the endless chains; means rotatably supporting said sprockets at the near and far end of said extension arm, said sprockets at the far end of said extension arm are axially aligned with said endless digging member being located therebetween to thereby form the central part of a digging head;

said digging head includes drum means affixed to opposed sides of said sprockets at the far end of said extension arm, an auger flight formed about each drum periphery, cutting teeth arranged in mounted relationship on the periphery of said auger flight and on said cutter plates; the flights on opposed sides of the sprockets are of a pitch to cause excavated material to move towards the endless digging member; conveyor means including said endless digging member by which excavated material is forced to move upwardly toward the main frame and then laterally away from said machine;

a curved shield assembly extending laterally the entire width of the drum means, said shield assembly circumferentially extends a limited circumferential distance about the digging head, said shield assembly is in the form of a first segment of a cylinder, means by which said first segment is supported in fixed relationship by the far end of said elongated arm in close proximity to said digging head; said shield assembly includes another segment of a cylinder which is slidably received by the first segment, said another segment has a lower end which terminates in a support shoe, said support shoe engages the ground to support the digging head and thereby control the depth of the excavation, and means for extending and retracting said another segment respective to said first segment and the digging head to thereby adjust the elevation of the digging head;

said means for moving said machine is spaced endless tracks arranged on opposed sides of said main frame, said elongated arm is journaled to said main frame and includes means attached thereto for pivoting the digging head from a position above the ground to a position below ground level.

5. The machine of claim 4 wherein an elongated shaft is fixed to the far end of said extension arm and supports the sprockets at the far end of the extension arm, said extension arm is pivotally connected to said main frame along an axis which coincides with the axis of the drive sprockets.

6. In a digging machine for planing a road or the like, said machine having endless tracks mounted to support a main frame; means, including a prime mover and drive train, for moving said machine along the ground, the improvement comprising:

an elongated digging apparatus including an elongated support arm having a near end and a far end, axially spaced drive sprocket means mounted at the near end of the support arm, and an elongated shaft mounted at the far end thereof, said shaft having opposed ends, means pivotally mounting the near end of said support arm to said main frame; axially aligned spaced sprockets rotatably mounted on said shaft;

a digging head supported by said shaft, spaced endless chains connected about the sprockets at the near and far ends of the support apparatus, means by which a plurality of digging teeth are supported by said endless chains which jointly form an endless central digging and conveying member; the far end of said central digging and conveying member forms part of said digging head;

said digging head includes spaced drums mounted in axial aligned relationship for rotation on opposed marginal ends of the shaft, means connecting the drums to be rotated by the far end sprockets; flights formed on said drums; digging teeth mounted on the drum flights for excavating geological formations; said digging teeth are aligned in a circular configuration that describes a cylinder, whereby the teeth on one side of each of the drums simultaneously engage and dig into the ground;

said flights on opposed sides of the shaft are of a pitch to cause excavated material to move towards the endless digging member;

means including said central digging and conveying member by which any excavated material is moved to a higher elevation where the excavated material is then moved laterally away from proximity of the digging machine;

a shield and support means is mounted at said far end of said support arm and extends circumferentially around part of the digging head and into contact with the ground, said shield means comprises a first and a second coacting segment of a cylinder having an axis that coincides with the axis of the digging head; said shield means includes a curved fixed segment which is attached to support the far end of the support arm and extends downwardly towards the ground and slidably supports said movable segment; said fixed and movable segments form a segment of a cylinder which can be adjusted in circumferiential length; means connecting the two segments together for movement in a slidable manner respective to one another to thereby selectively change the circumference of the shield; means forming a shoe at the lower end of the slidable segment, said shoe engages the ground and supports the digging head at a selected elevation to control the depth of the excavation as the two segments move respective to one another.

* * * * *

UNITED STATES PATENT AND TRADEMARK OFFICE

CERTIFICATE OF CORRECTION

PATENT NO. :4,755,001

DATED :July 5, 1988

INVENTOR(S) :JERRY F. GILBERT

It is certified that error appears in the above-identified patent and that said Letters Patent is hereby corrected as shown below:

In the title of the invention correct the spelling of "PLANER";

Column 1, line 1, correct the spelling of the title "ROAD PLANER";

Column 8, line 1, substitute --control-- for "central".

Signed and Sealed this

Third Day of January, 1989

*Attest:*

DONALD J. QUIGG

*Attesting Officer*

*Commissioner of Patents and Trademarks*